US005542855A

United States Patent [19]

Asai

[11] Patent Number: 5,542,855

[45] Date of Patent: Aug. 6, 1996

[54] ZERO INSERTION FORCE CONNECTOR

[75] Inventor: Kiyoshi Asai, Tokyo, Japan

[73] Assignees: SMK Corporation, Tokyo, Japan; Hewlett-Packard Company, Palo Alto, Calif.

[21] Appl. No.: 272,251

[22] Filed: Jul. 8, 1994

[30] Foreign Application Priority Data

Sep. 9, 1993 [JP] Japan ..... 5-053904 U

[51] Int. Cl.[6] ..... H01R 13/00

[52] U.S. Cl. ..... 439/260; 439/495

[58] Field of Search ..... 439/259, 260, 439/263, 264, 265, 492, 493, 495, 834, 835, 848, 861, 862, 863

[56] References Cited

U.S. PATENT DOCUMENTS 4,477,137 10/1984 Ayer ..... 439/495
4,640,562 2/1987 Shoemaker ..... 439/495
4,863,395 9/1989 Babuka et al. ..... 439/260
5,213,534 5/1993 Gardner et al. ..... 439/495
5,240,430 8/1993 Soes ..... 439/495

*Primary Examiner*—Neil Abrams
*Assistant Examiner*—Hion D. Vu
*Attorney, Agent, or Firm*—Christopher R. Pastel; Thomas R. Morrison

[57] ABSTRACT

A zero insertion force connector, typically used for connecting a flexible printed circuit (FPC) or a flexible flat cable (FFC) to a printed circuit board, is made up of an insertion aperture formed on one side of a housing, a pressure plate insertion aperture formed on a different side of the housing, a pressure plate, and a sigmoid contact member. When the pressure plate is inserted into the pressure plate insertion aperture, a finger piece of the sigmoid contact member resiliently changes position, and a tongue piece of the sigmoid contact member makes electrical contact with an inserted FPC or FFC. Since the tongue piece of the sigmoid contact member is arranged so that the tongue piece does not come into contact with the FPC or FFC unless the pressure plate is inserted, there is no requirement to force the FPC or FFC into the insertion aperture.

12 Claims, 5 Drawing Sheets

ZERO INSERTION FORCE CONNECTOR

BACKGROUND OF THE INVENTION

The present invention relates to a zero insertion force (ZIF) connector used on a circuit board for receiving a flexible printed circuit (FPC) board or a flexible flat cable (FFC). The ZIF connector includes a housing having an aperture on one side for receiving an FPC or FFC and an aperture on a different side for receiving a pressure plate. Inserting the pressure plate into the housing creates a force sufficient to hold the FPC or FFC in place with good electrical connectivity. When the pressure plate is removed, the FPC or FFC can be freely inserted or removed with little or no force.

A typical connector requires the use of force for inserting or removing an FPC or FFC. The act of inserting typically accomplishes two functions: placing the connector in the proper location, and ensuring positive electrical contact. Referring to prior art FIGS. 6 and 7, a connector 10 of an FPC or FFC includes a housing 13 and a contact 12. Contact 12 includes upper tongue piece 21 and lower tongue piece 22. A terminal 23 protrudes from the back surface of housing 13. Holding pieces 27 protrude from the sides of housing 13 and are fixedly attached to one side of a printed circuit board 26 by any convenient means, such as, for example, solder 28.

A cover 14 includes notch 18, insertion plate 19, and engagement pieces 20. The cover 14 is inserted into an insertion aperture 15 until the engagement pieces 20 of cover 14 are engaged by holding pieces 27. A stopper 17 prevents the cover 14 from being inserted too far into insertion aperture 15. The cover 14 is held in place by engagement protrusions 16 which cause elastic deformation of engagement pieces 20 as they pass over the engagement protrusions 16.

Insertion plate 19 provides support for an FPC 25. FPC 25 is positioned such that notch 18 is above FPC 25 and the insertion plate 19 is below FPC 25.

As best shown in FIG. 6, when cover 14 is inserted into insertion aperture 15, insertion plate 19 is interposed between the bottom surface of FPC 25 and lower tongue piece 22. The top surface of FPC 25 is forced into contact with the bottom of upper tongue piece 21. This causes upper tongue piece 21 to bend toward gap 24. In this way, FPC 25 and upper tongue piece 21 are held together by the tension force of upper tongue piece 21.

However, force is required to insert FPC 25 and insertion plate 19 between the upper and lower tongue pieces. Force is also required to remove FPC 25 and cover 14, and the procedure can become difficult. If too much force is used, pieces tend to break.

OBJECTS AND SUMMARY OF THE INVENTION

It is an object of the present invention to overcome the above limitations in the prior art and to provide a connector that is easy to use for inserting or removing a flexible printed circuit (FPC) or flexible flat cable (FFC) from a printed circuit board.

It is a further object of the present invention to provide a ZIF connector that requires little or no force to insert or remove an FPC or FFC from a printed circuit board.

In brief, a zero insertion force connector, typically used for connecting a flexible printed circuit (FPC) or a flexible flat cable (FFC) to a printed circuit board, is made up of an insertion aperture formed on one side of a housing, a pressure plate insertion aperture formed on a different side of the housing, a pressure plate, and a sigmoid contact member. When the pressure plate is inserted into the pressure plate insertion aperture, a finger piece of the sigmoid contact member resiliently changes position, and a tongue piece of the sigmoid contact member makes electrical contact with an inserted FPC or FFC. Since the tongue piece of the sigmoid contact member is arranged so that the tongue piece does not come into contact with the FPC or FFC unless the pressure plate is inserted, there is no requirement to force the FPC or FFC into the insertion aperture.

An embodiment of the present invention is a connector which includes a housing, a first insertion aperture on a side of the housing, means for receiving an element having at least one contact thereon into the first insertion aperture, a second insertion aperture on a different side of the housing, means for receiving a pressure plate into the second insertion aperture, at least one sigmoid contact member within and attached to the housing, with the contact being aligned with the sigmoid contact member when the element is inserted in the first insertion aperture, and means responsive to inserting into the second insertion aperture for urging the sigmoid contact member into mechanical and electrical connection with the contact.

According to an embodiment of the present invention, each sigmoid contact member includes a supporting element having a terminal at a first end and an engagement piece at a second end, an elongated S-shaped resilient connecting element having a first end and a second end, with the first end of the connecting element being connected to the supporting element at a connecting area, a tongue element having a first end and a second end, with the first end of the tongue element being connected perpendicular to the second end of the connecting element, the second end of the tongue element having a contact area disposed on a side thereof, a finger element having a first end and a second end, with the first end of the finger element being connected axially to the second end of the connecting element, a projecting nub disposed on a side of the second end of the finger element, whereby displacing said nub elastically deforms the connecting element and displaces the second end of the tongue piece, and the tongue element, the connecting element, and the supporting element are electrically conductive.

According to another embodiment of the present invention, the connector also includes means for connecting the sigmoid contact member to a printed circuit board, and means for securing the contact engagement piece to the housing.

According to another embodiment of the present invention, each sigmoid contact member also includes a contact nub protruding from the tongue piece into the first insertion aperture, and a finger piece nub protruding from the finger piece into the second insertion aperture.

According to another embodiment of the present invention, the connecting means includes a terminal attached to the supporting piece, the securing means includes at least one engagement tooth attached to the contact engagement piece, and the securing means includes at least one engagement aperture in the housing such that the contact engagement piece fits securely into the engagement aperture.

According to another embodiment of the present invention, the finger piece of the connector changes position when the pressure plate is inserted into the second insertion aperture, whereby the resilient connecting piece elastically deforms and the tongue piece changes position, and the contact nub is disposed in the insertion aperture so that the contact nub comes into electrical contact with the element when the pressure plate is inserted into the second insertion aperture.

According to another embodiment of the present invention, the first insertion aperture and second insertion aperture face 90° apart.

According to another embodiment of the present invention, the pressure plate includes a pressure plate body integrally protruding downward lengthwise, a plurality of resilient pressure plate engagement pieces integrally protruding downward from each of a first and second end of the pressure plate, and a plurality of pressure plate engagement protrusions integrally protruding inward from the resilient pressure plate engagement pieces.

According to another embodiment of the present invention, the element includes one of a flexible printed circuit (FPC) or a flexible flat cable (FFC).

According to another embodiment of the present invention, a zero insertion force connector includes a housing, means for receiving a first element having at least a first contact thereon into the housing, means for receiving a pressure plate into the housing, at least an electrically conductive sigmoid contact member within and attached to the housing, means responsive to the pressure plate receiving means for urging the sigmoid contact member into mechanical and electrical connection with the first contact, and means for electrically connecting the sigmoid contact member to a second contact disposed on a second element.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
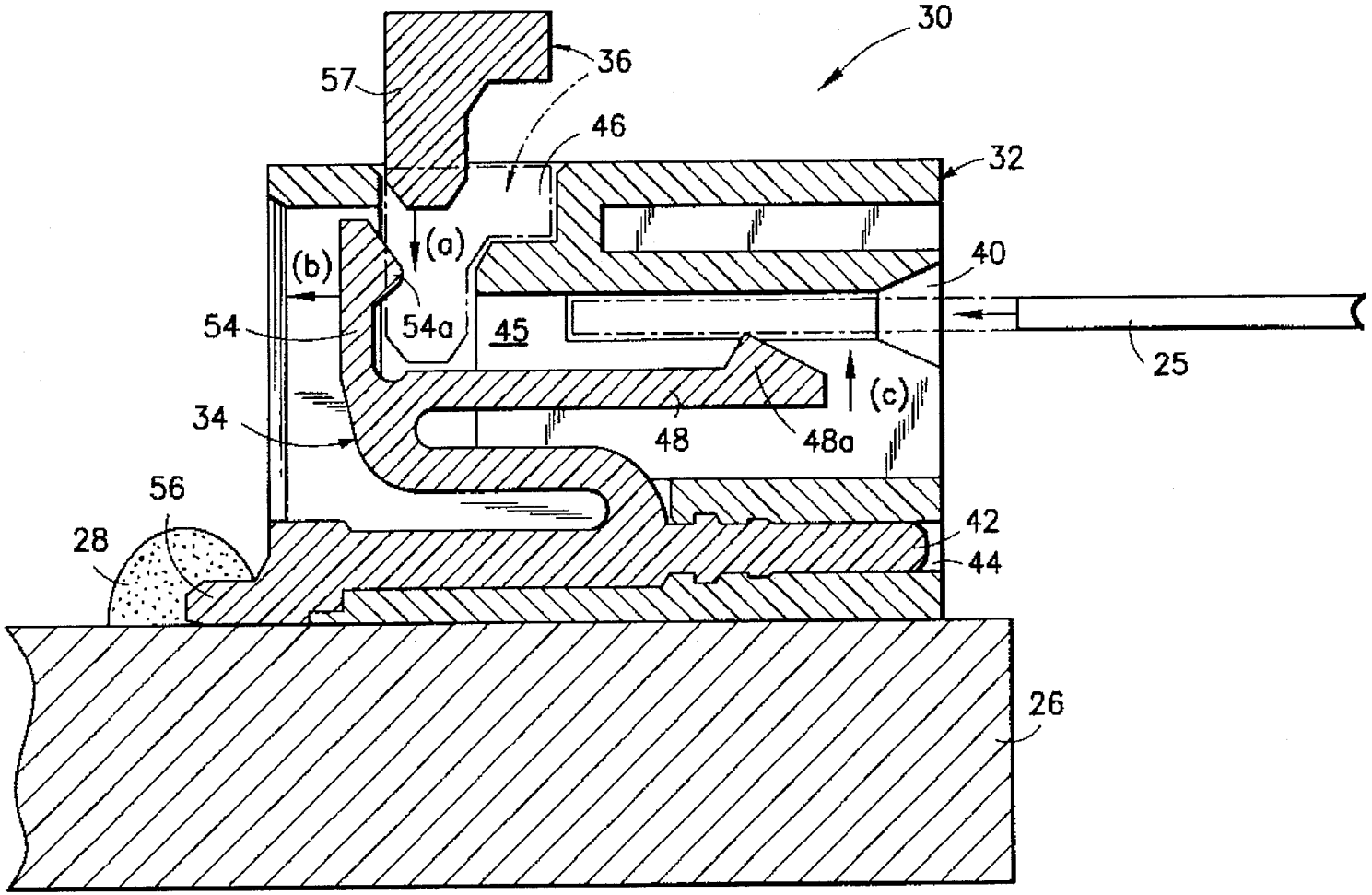
FIG. 1 shows a cross,sectional view of a ZIF connector along the line A—A of FIG. 2.

Referring to FIG. 1, a ZIF connector 30 includes a housing 32 with an insertion aperture 40 formed on one side and a pressure plate insertion aperture 46 formed on a different side. In addition, ZIF connector 30 includes pressure plate 36 and sigmoid contact members 34.

Insertion aperture 40 is located on the front side of housing 32 so that an FPC 25 can be inserted. Aperture stopper 45 ensures that FPC 25 is properly positioned when fully inserted. Pressure plate insertion aperture 46 is located on the top of housing 32 to receive pressure plate 36. Each sigmoid contact member 34 includes a supporting piece 52 that extends into a terminal 56 on one end and a contact engagement piece 42 and a connecting piece 50 on the other. Terminal 56 is connected to printed circuit board 26 by solder 28. Contact engagement piece 42 fits into engagement aperture 44. A plurality of engagement teeth **42*a* secures sigmoid contact member 34 to housing 32**.

Connecting piece 50 curves upwards from supporting piece 52 and divides into a finger piece 54 and a tongue piece 48. Tongue piece 48, connecting piece 50, and supporting piece 52 form an "S" shaped curve. Finger piece 54 has a finger piece nub 54a which extends into pressure plate insertion aperture 46. Tongue piece 48 has a contact **48*a* that extends into insertion aperture 40**.

The dash-double-dot line shows pressure plate 36 fully inserted into housing 32 in the direction shown by arrow (a). In this position, pressure plate body 57 engages finger piece nub **54*a*, whereby finger piece 54 resiliently moves in the direction shown by arrow (b). Since contact engagement piece 42 is engaged and fixed in engagement aperture 44, and supporting piece 52 is supported by housing 32, connecting piece 50 and tongue piece 48 also resiliently move. Contact 48*a* rotates in the direction shown by arrow (c) and is thus forced into contact with FPC 25. In other words, inserting pressure plate 36 into pressure plate insertion aperture 46 causes each of the sigmoid contact members 34 to make electrical contact with FPC 25**.

Figure 2:
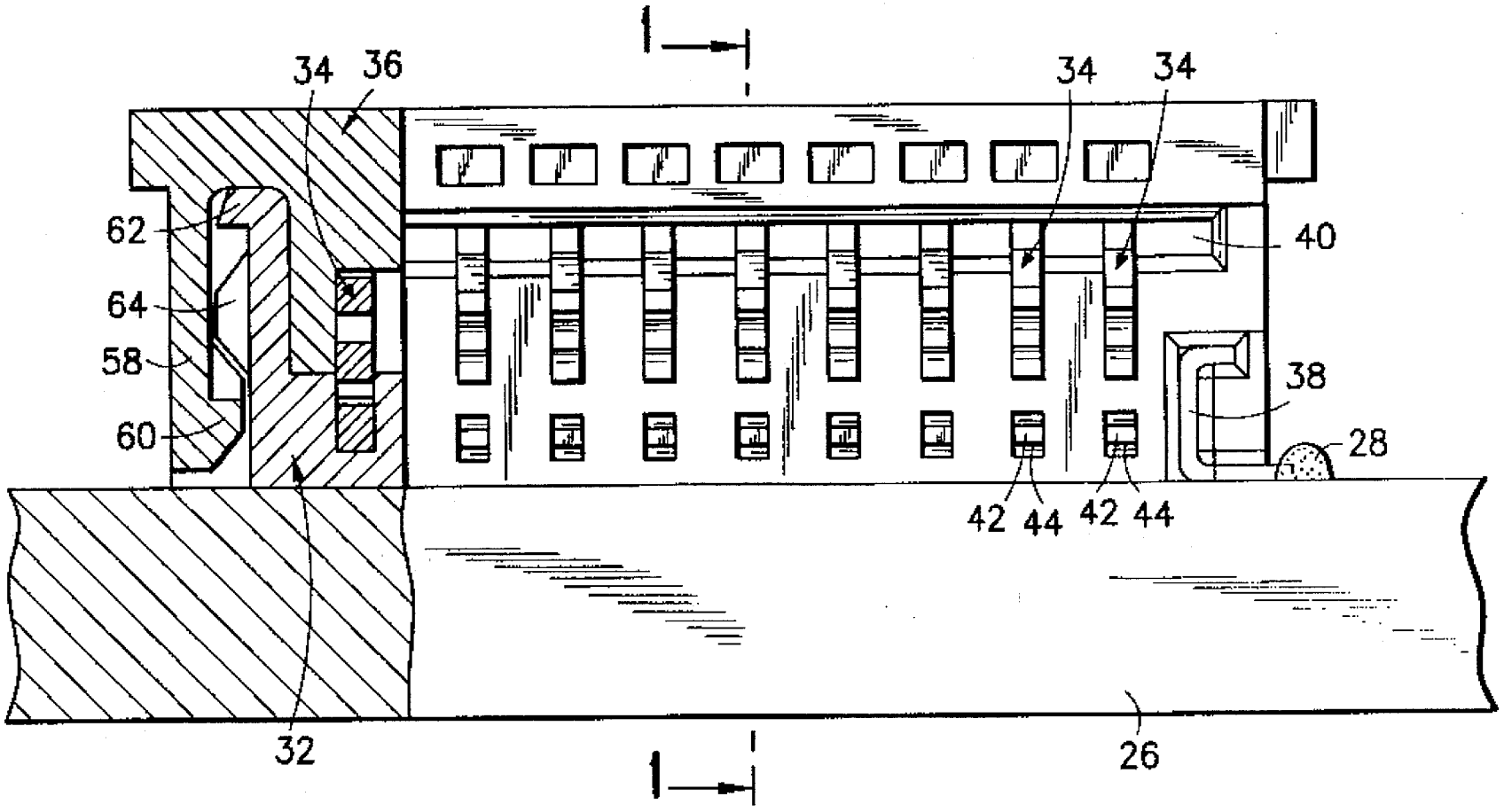
FIG. 2 shows a cross-sectional view of a ZIF connector along the line B—B of FIG. 3.

Referring to FIG. 2, connector supports 38 protrude outside the lower part of housing 32 and are fixed onto printed circuit board 26 by solder 28. Each end of pressure plate 36 includes a pressure plate engagement piece 58 which has a pressure plate engagement protrusion 60 extending inwardly. Housing 32 includes a stopper 62 to help ensure the proper positioning of pressure plate 36. Housing 32 also includes a housing engagement protrusion 64. When pressure plate 36 is inserted into pressure plate insertion aperture 46, housing engagement protrusions 64 engage pressure plate engagement protrusions 60 to prevent unwanted movement.

As pressure plate 36 is moved out of pressure plate insertion aperture 46, pressure plate engagement pieces 58 deform elastically when passing over housing engagement protrusions 64. This procedure requires sufficient force to prevent pressure plate 36 from accidently coming out of pressure plate insertion aperture 46.

Referring now to FIGS. 1 and 2, pressure plate 36 is moved out of pressure plate insertion aperture 46 by disengaging pressure plate engagement protrusions 60 from housing engagement protrusions 64 and moving pressure plate 36 from the position shown by dash-double-dot line to the position shown by the solid line. Pressure plate engagement protrusions 60 engage stoppers 62, thus preventing pressure plate 36 from totally disengaging from housing 32.

When pressure plate 36 is in this position, FPC 25 is inserted into insertion aperture 40 until its front edge comes into contact with aperture stopper 45. In this position, tongue piece 48 is not deformed and contact **48*a* is out of contact with FPC 25. In other words, with pressure plate 36 in the raised position, as shown by the solid line in FIG. 1, FPC 25 can be inserted and removed from insertion aperture 40** with little or no force.

Figure 3:
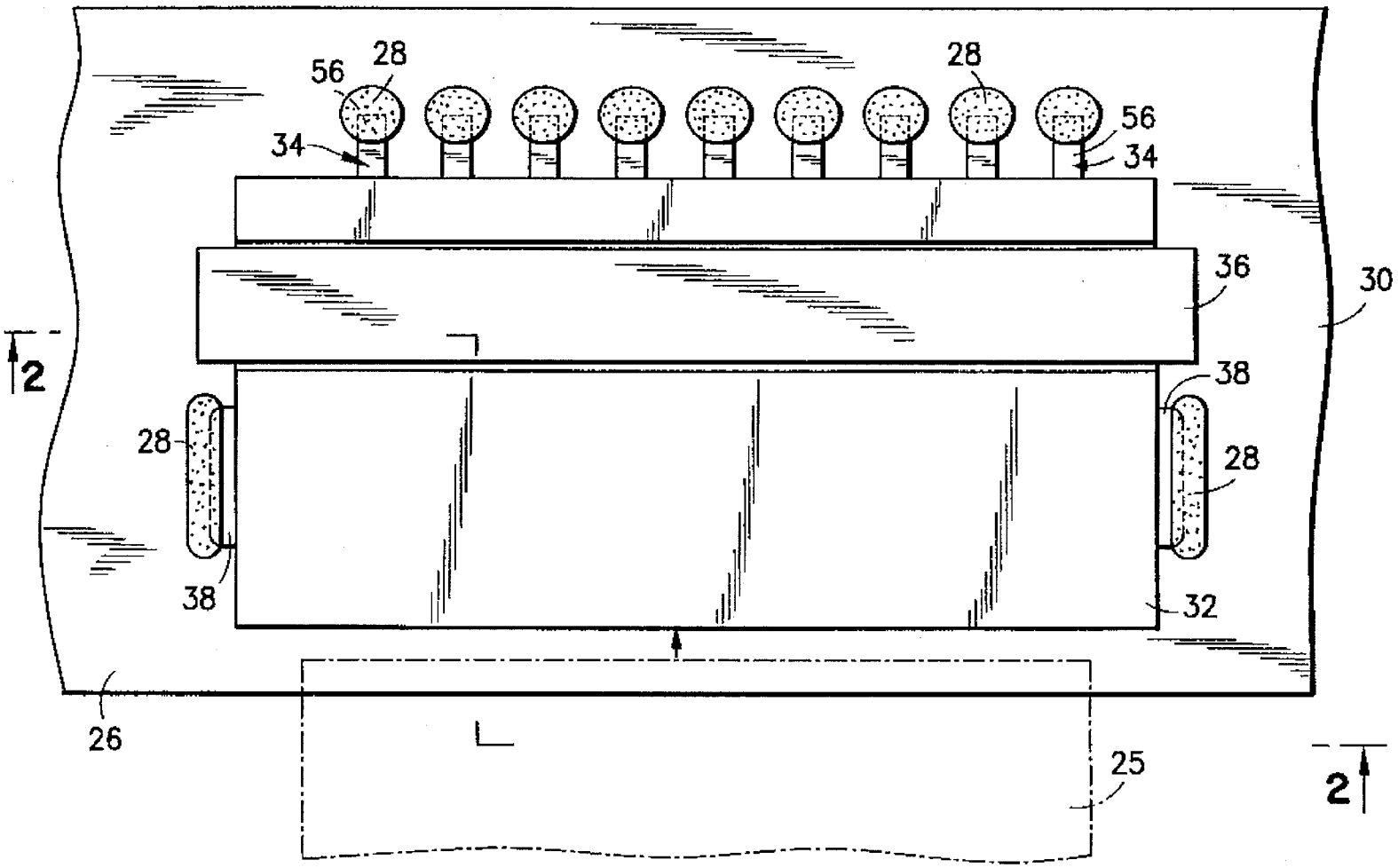
FIG. 3 shows a plan view of a ZIF connector according to an embodiment of the present invention.

Referring to FIG. 3, each terminal 56 of each sigmoid contact member 34 is connected to printed circuit board 26 by solder 28 on the back side of housing 32. The number of sigmoid contact members 34 depends on the FPC or FFC being connected. FPC 25 is inserted from the front side of housing 32. Connector supports 38 are on each of the two sides of housing 32 and are fixed to printed circuit board 26 by solder 28. Pressure plate 36 is inserted from the top of housing 32.

Figure 4:
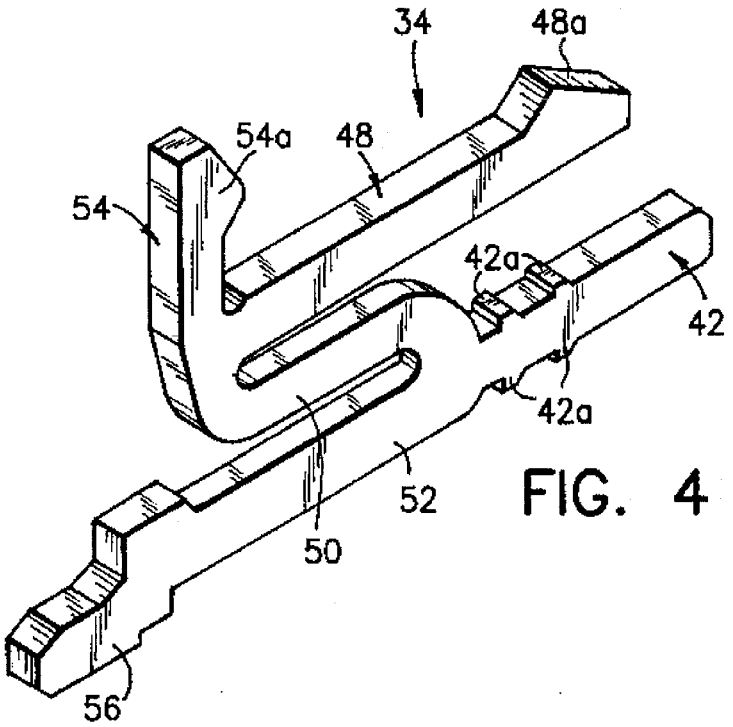
FIG. 4 shows a perspective view of a sigmoid contact member according to an embodiment of the present invention.

Referring to FIG. 4, sigmoid contact member 34 is integrally formed and made of a conductive resilient material. Sigmoid contact member 34 includes supporting piece 52, connecting piece 50 curvedly attached to supporting piece 52, tongue piece 48 curvedly attached to connecting piece 50, finger piece 54 extending upward from the connecting area of tongue piece 48 and connecting piece 50, and contact engagement piece 42 longitudinally extending from the connecting area of one end of supporting piece 52 and connecting piece 50. Terminal 56 extends from the other end of supporting piece 52. Engagement teeth 42*a* are on contact engagement piece 42. Finger piece 54 includes finger piece nub 54a. Tongue piece 48 includes contact 48*a*.

Figure 5:
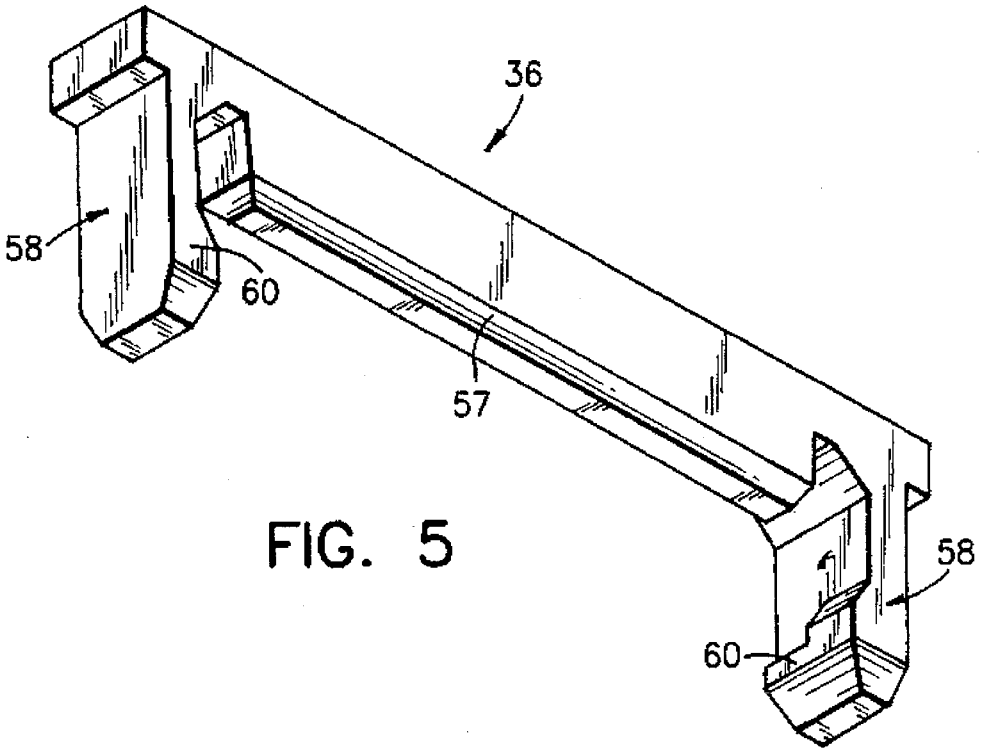
FIG. 5 shows a perspective view of a pressure plate according to an embodiment of the present invention.
Figure 6:
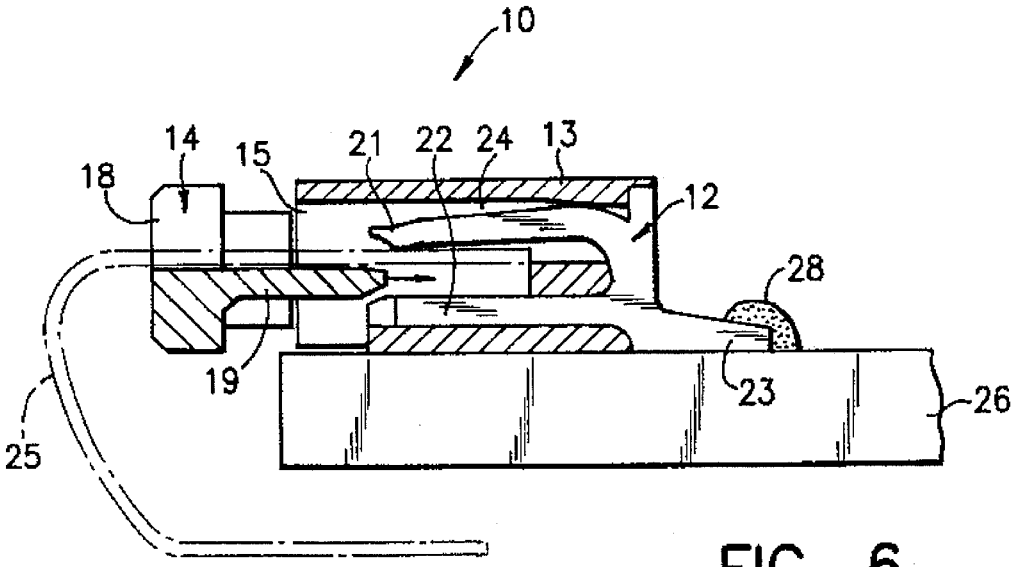
FIG. 6 PRIOR ART
FIG. 6 shows a cross-sectional view of a prior art FPC connector.
Figure 7:
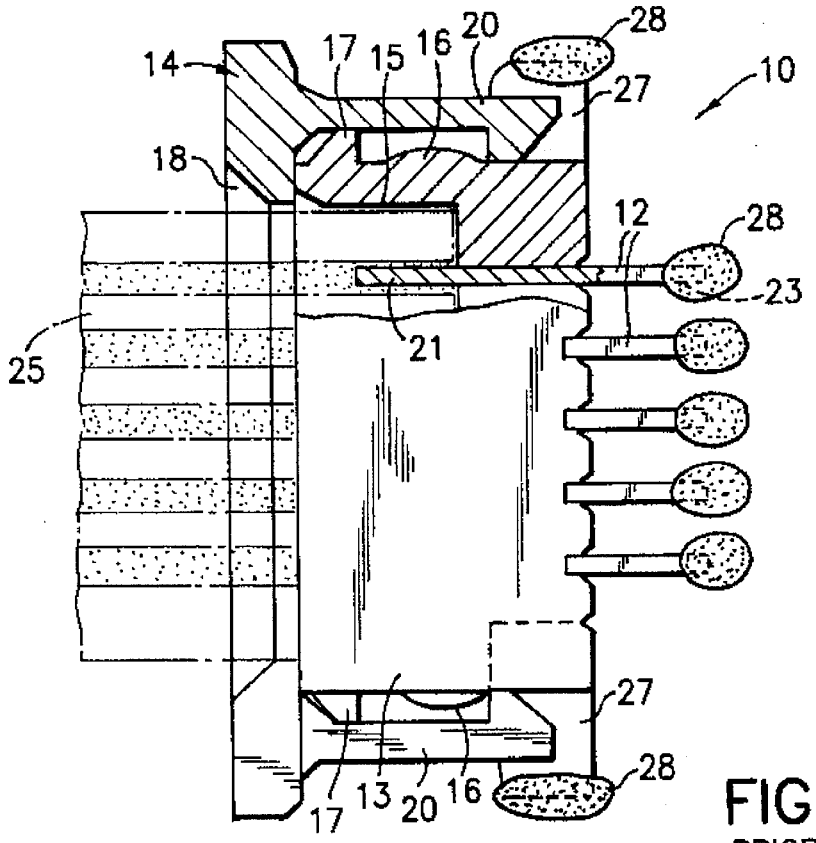
FIG. 7 PRIOR ART
FIG. 7 shows a plan view of the prior art FPC connector of FIG. 6 with one section cut out.

Referring to FIG. 5, pressure plate 36 includes an integral pressure plate body 57 protruding downward lengthwise, and integral resilient pressure plate engagement pieces 58 protruding downward on both ends. Pressure plate engagement pieces 58 include integral pressure plate engagement protrusions 60 which protrude inward towards each other.

In the embodiment described above, insertion aperture 40 is formed on the front side of the housing. Pressure plate insertion aperture 46 is formed on the top side of the housing. The present invention is not limited to this configuration. The insertion aperture 40 could be formed on one side of the housing and the pressure plate insertion aperture 46 could be formed on another side without departing from the spirit and scope of the invention.

In the embodiment described above, tongue piece 48 of sigmoid contact member 34 is formed so that contact 48*a* is not in contact with inserted FPC 25 when pressure plate 36 is removed. As noted above, this was to provide a feature allowing insertion without having to overcome a friction force. The present invention is not limited to this embodiment, and can be used for embodiments where contact 48*a* comes into electrical contact with the FPC 25 upon insertion even with the pressure plate removed.

Nine rows of sigmoid contact members 34 are illustrated, but the present invention is not limited to this. The embodiment can be used for FPC connectors with greater or fewer sigmoid contact members. Connector 30 may be used as an FPC connector or an FFC connector.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A connector, comprising:

a housing;

a first insertion aperture on a side of said housing;

means for receiving an element having at least one contact thereon into said first insertion aperture;

a second insertion aperture on a different side of said housing;

means for receiving a pressure plate into said second insertion aperture;

at least one sigmoid contact member within and attached to said housing;

said at least one contact being aligned with said at least a sigmoid contact member when said element is inserted in said first insertion aperture;

means, responsive to inserting said pressure plate into said second insertion aperture, for urging said at least one sigmoid contact member into mechanical and electrical connection with said at least one contacts;

said at least one sigmoid contact member includes a supporting piece; a resilient connecting piece curvedly attached to said supporting piece at a first connecting area; a tongue piece curvedly attached to said connecting piece at a second connecting area; a contact engagement piece longitudinally attached to said supporting piece at said first connecting area; and a finger piece perpendicularly attached to said tongue piece at said second connecting area.

2. The connector as recited in claim 1, further comprising:

means for connecting said sigmoid contact member to a printed circuit board; and means for securing said contact engagement piece to said housing.

3. The connector as recited in claim 1, wherein each sigmoid contact member further comprises:

a finger piece nub protruding from said finger piece into said second insertion aperture; and a contact nub protruding from said tongue piece into said first insertion aperture.

4. The connector as recited in claim 3, wherein:

said connecting means includes a terminal attached to said supporting piece;

said securing means includes at least one engagement tooth attached to said contact engagement piece; and said securing means includes an engagement aperture in said housing such that said contact engagement piece fits securely into said engagement aperture.

5. The connector as recited in claim 4, wherein each sigmoid contact member is electrically conductive.

6. The connector as recited in claim 3, wherein:

said finger piece changes position when said pressure plate is inserted into said second insertion aperture, whereby said resilient connecting piece elastically deforms and said tongue piece changes position; and said contact nub is arranged in said insertion aperture so that said contact nub comes into electrical contact with said at least a contact of said element when said pressure plate is inserted into said second insertion aperture.

7. The connector as recited in claim 1, wherein said first insertion aperture and said second insertion aperture face 90° apart.

8. The connector as recited in claim 1, wherein said pressure plate further comprises:

a pressure plate body integrally protruding downward lengthwise;

a resilient pressure plate engagement piece integrally protruding downward from each of a first and second end of said pressure plate; and a pressure plate engagement protrusion integrally protruding inward from each of said resilient pressure plate engagement pieces.

9. The connector as recited in claim 1, wherein said element comprises one of a flexible printed circuit (FPC) and flexible flat cable (FFC).

10. A sigmoid contact member, comprising:

a supporting element having a terminal at a first end and an engagement piece at a second end;

an elongated S-shaped resilient connecting element having a first end and a second end;

said first end of said connecting element being connected to said supporting element at a connecting area;

a tongue element having a first end and a second end;

said first end of said tongue element being connected perpendicular to said second end of said connecting element;

said second end of said tongue element having a contact area disposed on a side thereof;

a finger element having a first end and a second end;

said first end of said finger element being connected axially to said second end of said connecting element;

a projecting nub disposed on a side of said second end of said finger element, whereby displacing said nub elastically deforms said connecting element and displaces said second end of said tongue piece; and said tongue element, said connecting element, and said supporting element are electrically conductive.

11. A sigmoid contact member as recited in claim 10, wherein said tongue element, said connecting element, said supporting element, and said finger element are integrally formed.

12. A sigmoid contact member as recited in claim 10, wherein said engagement piece has at least one engagement tooth disposed on a side thereof.

* * * * *